US009093236B2

(12) United States Patent
Ho

(10) Patent No.: US 9,093,236 B2
(45) Date of Patent: Jul. 28, 2015

(54) ILLUMINATED KEYBOARD

(71) Applicant: Primax Electronics Ltd., Neihu, Taipei (TW)

(72) Inventor: Hsuan-Wei Ho, Taipei (TW)

(73) Assignee: PRIMAX ELECTRONICS LTD., Neihu (TW)

( * ) Notice: Subject to any disclaimer, the term of this patent is extended or adjusted under 35 U.S.C. 154(b) by 141 days.

(21) Appl. No.: 14/068,135

(22) Filed: Oct. 31, 2013

(65) Prior Publication Data

US 2015/0014135 A1 Jan. 15, 2015

(30) Foreign Application Priority Data

Jul. 12, 2013 (TW) ..... 102125103 A

(51) Int. Cl.

| | |
|---|---|
| ***H01H 9/26*** | (2006.01) |
| ***H01H 13/72*** | (2006.01) |
| ***H01H 13/76*** | (2006.01) |
| ***H01H 13/83*** | (2006.01) |

(52) U.S. Cl.

CPC . *H01H 13/83* (2013.01); *H01H 9/26* (2013.01)

(58) Field of Classification Search

CPC ..... G06F 3/1446; G09G 2300/026; G02F 1/13336; H01L 27/3293; H01H 9/26; H01H 13/72; H01H 13/76; H01H 9/00; H01H 3/48; H01H 13/70; H01H 1/06; H01H 3/12; H01H 1/60; H01H 2227/032; H01H 2227/034; H01H 13/84; H01H 13/85; H01H 35/00; H01H 35/2614; H01H 35/2621; H01H 35/2628; H01H 35/2685; H01H 2211/032

USPC ..... 200/5 A, 600, 512, 314; 345/173

See application file for complete search history.

(56) References Cited

U.S. PATENT DOCUMENTS

| | | | | |
|---|---|---|---|---|
| 5,424,516 | A * | 6/1995 | Emmons | 200/344 |
| 2010/0045612 | A1* | 2/2010 | Molne | 345/173 |
| 2012/0313738 | A1* | 12/2012 | Chang et al. | 335/205 |

* cited by examiner

*Primary Examiner* — Edwin A. Leon
*Assistant Examiner* — Anthony R. Jimenez
(74) *Attorney, Agent, or Firm* — Kirton McConkie; Evan R. Witt

(57) ABSTRACT

An illuminated keyboard comprises a fixing sheet, a membrane switch circuit module, a supporting plate, a light guide plate, a sensing circuit, a sensing chip, a light-emitting element, and an illumination circuit board. The sensing circuit is formed on the fixing sheet or the membrane switch circuit module. The sensing chip and the light-emitting element are disposed on the illumination circuit board. In addition, the sensing chip is accommodated within corresponding openings of the fixing sheet, the membrane switch circuit module, the supporting plate and the light guide plate. The illuminated keyboard uses the sensing circuit and the sensing chip to sense the presence of an object. Since the illuminated keyboard does not need an additional space to accommodate the sensing circuit and the sensing chip, the illuminated keyboard can meet the requirement of slimness.

16 Claims, 10 Drawing Sheets

ILLUMINATED KEYBOARD

FIELD OF THE INVENTION

The present invention relates to a keyboard, and more particularly to an illuminated keyboard with an object sensing function.

BACKGROUND OF THE INVENTION

A keyboard is one of the widely-used computer peripheral devices. Via the keyboard, the user may input characters or commands into a computer. FIG. 1 is a schematic top view illustrating the outward appearance of a conventional keyboard. As shown in FIG. 1, the conventional keyboard 1 comprises plural keys 10. When one of these keys 10 is depressed by the user's finger, a corresponding signal is transmitted from the keyboard 1 to the computer, so that a corresponding key function is implemented by the computer. For example, by depressing the key 101, a corresponding English letter or a corresponding symbol is inputted into the computer. By depressing the key 102, a corresponding number is inputted into the computer. Moreover, by depressing the key 103, a corresponding programmed function is quickly executed.

With increasing development of science and technology, the keyboard manufacturers make efforts in designing novel keyboards with special functions in order to meet the requirements of different users. Recently, an illuminated keyboard with an illuminating function has been introduced into the market. Consequently, in case that the illuminated keyboard is used in the dim environment with insufficient luminance, the characters marked on the keys of the illuminated keyboard are still clearly visible to the user.

Since the outward appearance of the conventional illuminated keyboard is similar to the outward appearance of the conventional keyboard 1, only the inner structure of the conventional illuminated keyboard will be illustrated in more details as follows. FIG. 2 is a schematic cross-sectional view illustrating a conventional illuminated keyboard.

Hereinafter, the components of the conventional illuminated keyboard will be illustrated with reference to FIG. 2. As shown in FIG. 2, the conventional illuminated keyboard 2 comprises at least one key 21, a membrane switch circuit module 22, a base plate 23, and a backlight module 24.

The key 21 comprises a keycap 211, a connecting element 212, and an elastic element 213.

Moreover, the membrane switch circuit module 22 comprises an upper wiring plate 221 and a lower wiring plate 222. An upper contact 221*a* is formed on the upper wiring plate 221. Corresponding to the upper contact 221*a*, a lower contact 222*a* is formed on the lower wiring plate 222.

Moreover, the backlight module 24 comprises a light guide plate 241, a reflective plate 242, and a light-emitting element 243.

An assembling process and the operating principle of the conventional illuminated keyboard 2 will be illustrated in more details as follows. Firstly, both of the key 21 and the membrane switch circuit module 22 are disposed on the base plate 23, and the backlight module 24 is disposed under the base plate 23.

In particular, the connecting element 212 of the key 21 is connected with the keycap 211 and the base plate 23. The elastic element 213 is disposed within the connecting element 212, and arranged between the keycap 211 and the base plate 23. The membrane switch circuit module 22 is arranged between the elastic element 213 and the base plate 23.

As the key 21 is depressed, the keycap 211 is correspondingly moved with the connecting element 212 in a vertical direction toward the base plate 23. Consequently, the membrane switch circuit module 22 is pushed by a protrusion part 213*a*, which is disposed within the elastic element 213. Under this circumstance, the upper contact 221*a* and the lower contact 222*a* of the membrane switch circuit module 22 are contacted with each other to be electrically conducted. Consequently, a corresponding input function is executed. Moreover, the elastic element 213 also provides an elastic force for allowing the keycap 213 to be moved upwardly or downwardly relative to the base plate 23.

Moreover, the light guide plate 241 is disposed under the base plate 23. The reflective plate 242 is disposed under the light guide plate 241. The light-emitting element 243 is located at a side of the light guide plate 241. The light-emitting element 243 is used for providing a light beam to illuminate the illuminated keyboard 2. After the light beam from the light-emitting element 243 is introduced into the light guide plate 241, the light beam is guided by the light guide plate 241 to be projected onto the base plate 23. Moreover, the light beam from the light-emitting element 243 may be reflected by the reflective plate 242, so that the light beam is transferred within the light guide plate 241 more uniformly.

However, the conventional illuminated keyboard 2 still has some drawbacks. Generally, the light-emitting element 243 is driven to emit the light beam when a backlight function of the illuminated keyboard 2 is enabled by the user, and the light-emitting element 243 is not driven when the backlight function of the illuminated keyboard 2 is disabled by the user. However, the illuminated keyboard 2 is unable to detect whether the user is located near the illuminated keyboard 2. That is, after the user is departed from the illuminated keyboard 2, the illumination of the light-emitting element 243 fails to be automatically disabled. Similarly, when the user is located near the illuminated keyboard 2, the illumination of the light-emitting element 243 fails to be automatically enabled.

In other words, it is usually inconvenient for the user to frequently enable or disable the backlight function of the illuminated keyboard.

Therefore, there is a need of providing an improved illuminated keyboard in order to eliminate the above drawbacks.

SUMMARY OF THE INVENTION

The present invention provides an illuminated keyboard with a small size and with an object sensing function.

In accordance with an aspect of the present invention, there is provided an illuminated keyboard. The illuminated keyboard includes a membrane switch circuit module, plural keys, a sensing circuit, an illumination circuit board, at least one light-emitting element, and a sensing chip. The membrane switch circuit module is used for generating plural key switch signals. In addition, the membrane switch circuit module includes a first opening The plural keys are disposed over the membrane switch circuit module. When one of the plural keys is depressed, the membrane switch circuit module generates a corresponding key switch signal. In addition, the plural keys comprise plural keycaps, respectively. The sensing circuit is disposed on the membrane switch circuit module. The at least one light-emitting element is disposed on the illumination circuit board. The sensing chip is disposed on the illumination circuit board. The sensing chip is penetrated through the first opening and electrically connected with the sensing circuit. The sensing chip is disposed under one of the plural keycaps for sensing a presence of an object.

In accordance with another aspect of the present invention, there is provided an illuminated keyboard. The illuminated keyboard includes a membrane switch circuit module, plural keys, a fixing sheet, a sensing circuit, an illumination circuit board, at least one light-emitting element, and a sensing chip. The membrane switch circuit module is used for generating plural key switch signals. In addition, the membrane switch circuit module includes a first opening The plural keys are disposed over the membrane switch circuit module. When one of the plural keys is depressed, the membrane switch circuit module generates a corresponding key switch signal. The plural keys include plural keycaps and plural elastic elements, respectively. The plural elastic elements are disposed under the corresponding keycaps. The fixing sheet is arranged between the plural keys and the membrane switch circuit module for fixing the plural elastic elements. In addition, the fixing sheet includes a second opening The sensing circuit is disposed on the fixing sheet. The at least one light-emitting element is disposed on the illumination circuit board. The sensing chip is disposed on the illumination circuit board. The sensing chip is penetrated through the first opening and the second opening and electrically connected with the sensing circuit. The sensing chip is disposed under one of the plural keycaps for sensing a presence of an object.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 3:
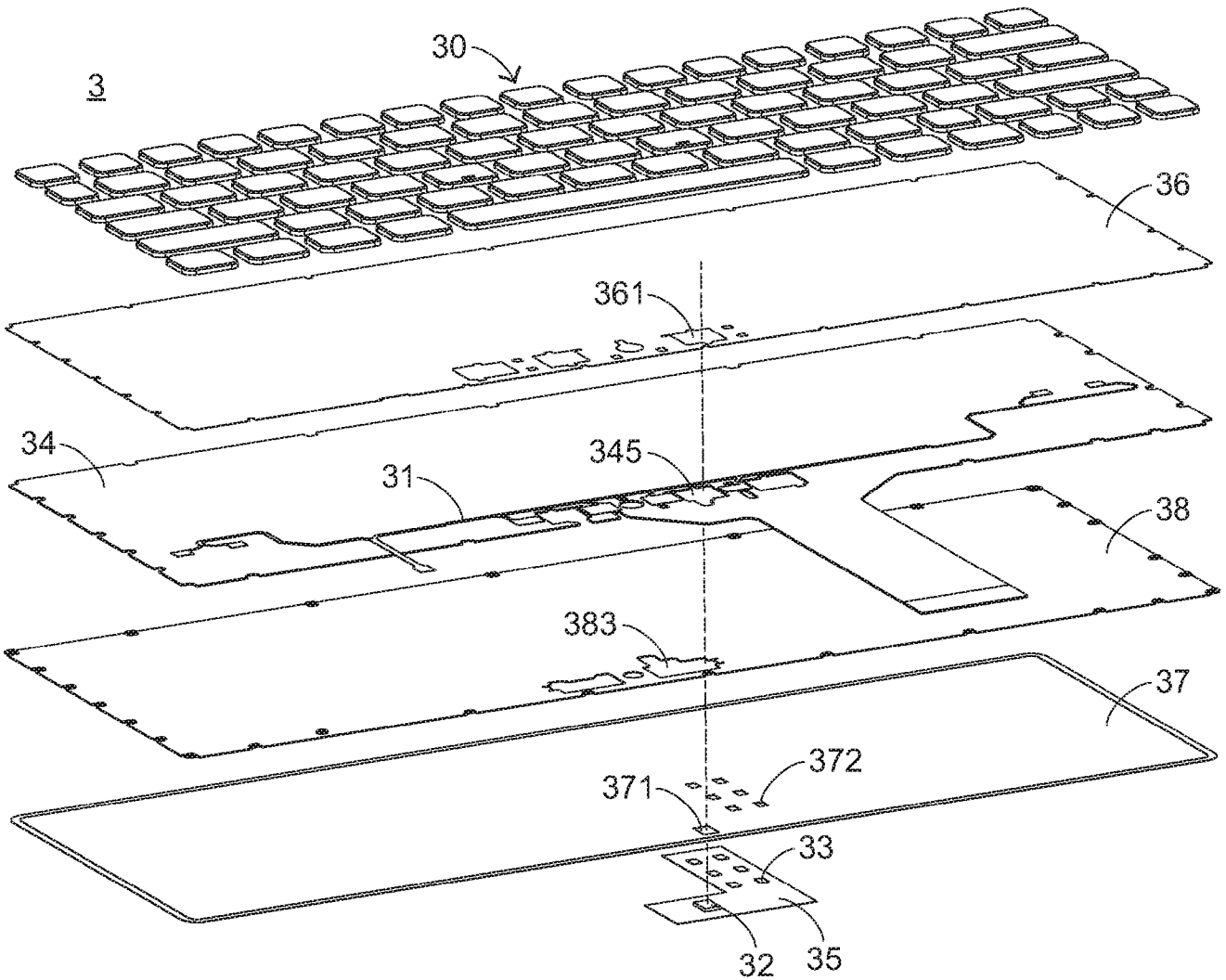
FIG. 3 is a schematic exploded view illustrating an illuminated keyboard according to a first embodiment of the present invention.
Figure 4:
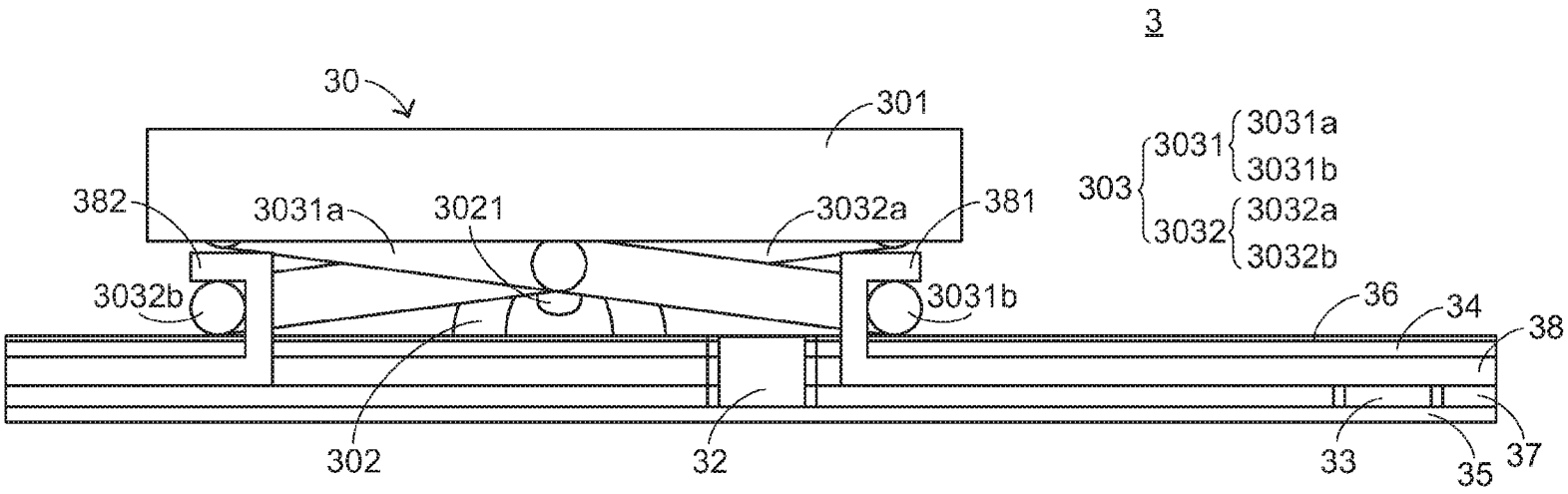
FIG. 4 is a schematic cross-sectional view illustrating the illuminated keyboard according to the first embodiment of the present invention.
Figure 5:
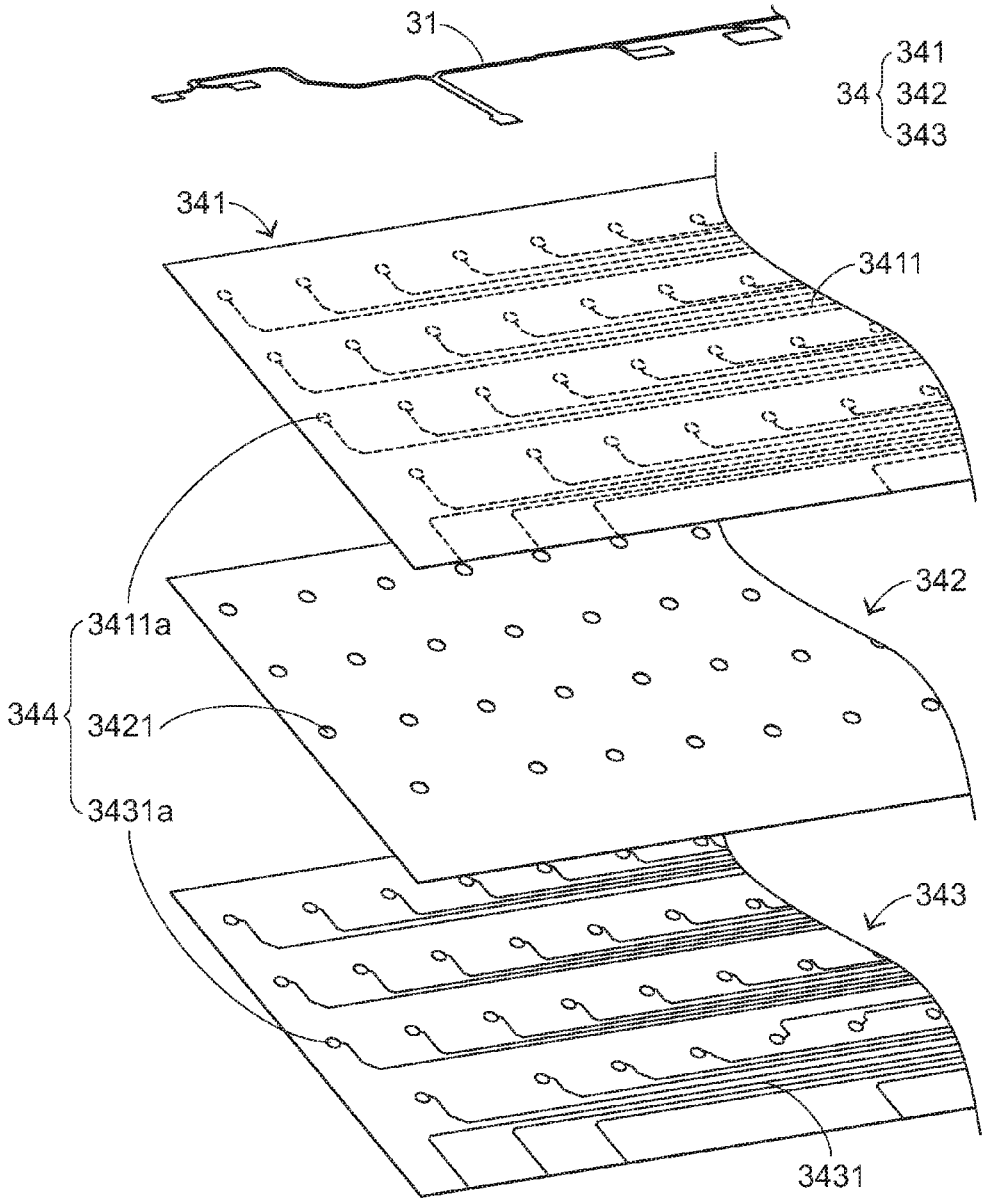
FIG. 5 is a schematic exploded view illustrating a membrane switch circuit module and a sensing circuit of the illuminated keyboard according to the first embodiment of the present invention.
Figure 6:
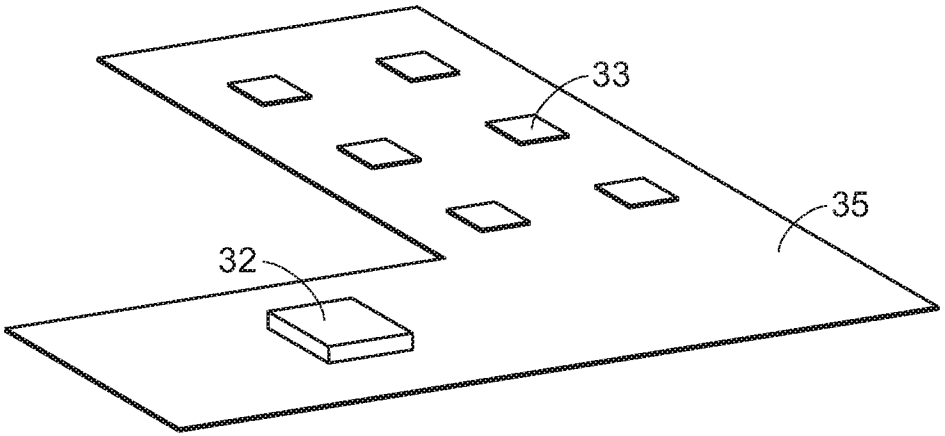
FIG. 6 is a schematic perspective view illustrating an illumination circuit board of the illuminated keyboard according to the first embodiment of the present invention.

Hereinafter, the structures of an illuminated keyboard with an object sensing function according to a first embodiment of the present invention will be illustrated with reference to FIGS. 3-6. FIG. 3 is a schematic exploded view illustrating an illuminated keyboard according to a first embodiment of the present invention. FIG. 4 is a schematic cross-sectional view illustrating the illuminated keyboard according to the first embodiment of the present invention. FIG. 5 is a schematic exploded view illustrating a membrane switch circuit module and a sensing circuit of the illuminated keyboard according to the first embodiment of the present invention. FIG. 6 is a schematic perspective view illustrating an illumination circuit board of the illuminated keyboard according to the first embodiment of the present invention. It is noted that the structure and the circuit pattern of each layer of the illuminated keyboard as shown in FIGS. 3-6 are presented herein for purpose of illustration and description only.

Figure 1:
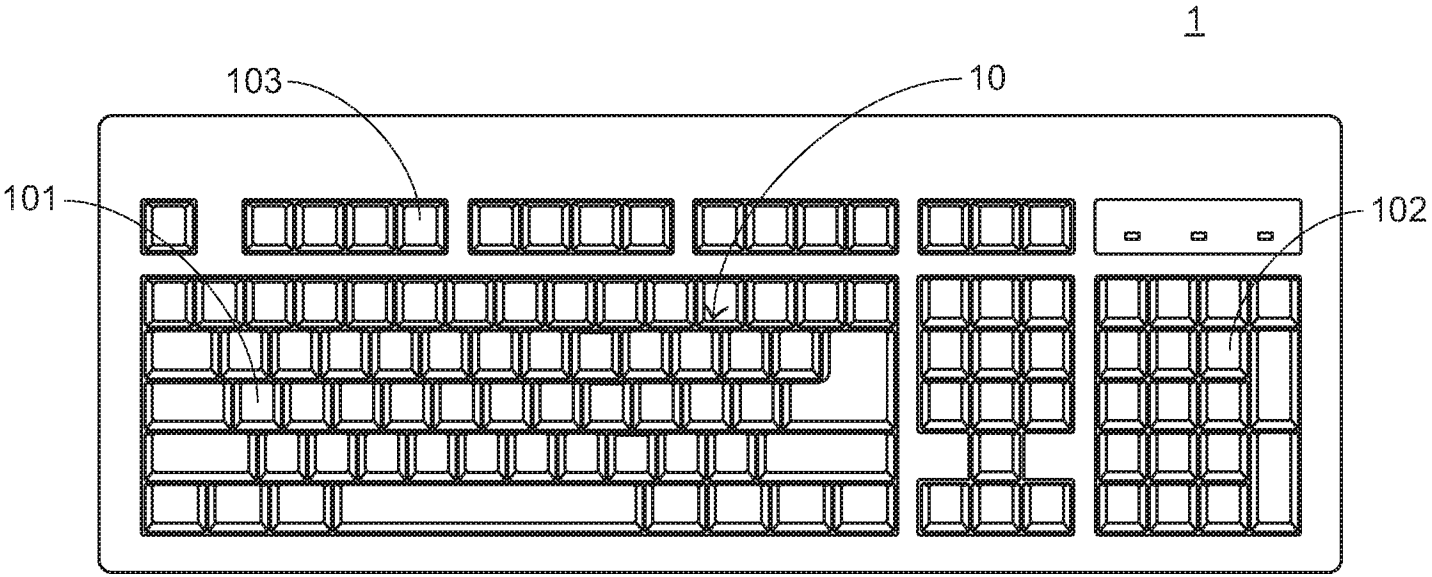
FIG.1 PRIOR ART
FIG. 1 is a schematic top view illustrating the outward appearance of a conventional keyboard.
Figure 2:
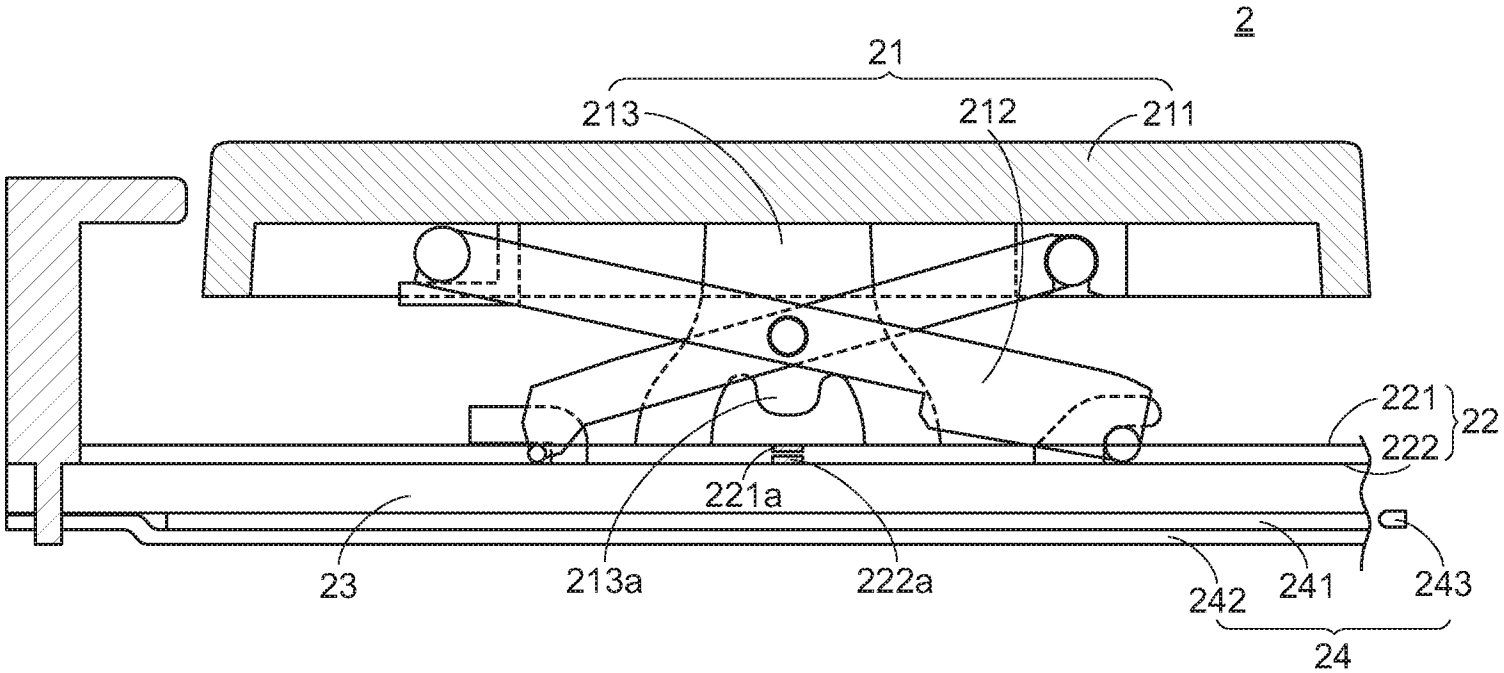
FIG.2 PRIOR ART
FIG. 2 is a schematic cross-sectional view illustrating a conventional illuminated keyboard.

In comparison with the conventional illuminated keyboard as shown in FIG. 2, the illuminated keyboard 3 of the present invention comprises a sensing circuit 31 and a sensing chip 32. The sensing circuit 31 is disposed under the plural keys 30. The sensing chip 32 is electrically connected with the sensing circuit 31. When a conducting object (e.g. a human body) is located near the plural keys 30, a sensing electric field generated by the sensing circuit 31 is subject to a change. According to the change of the sensing electric field, the sensing chip 32 can realize the presence of the conducting object. Consequently, plural light-emitting elements 33 are driven to emit light beams.

The components of the illuminated keyboard 3 and the sequence of assembling the illuminated keyboard 3 will be illustrated in more details as follows. Firstly, the illuminated keyboard 3 comprises the plural keys 30, the sensing circuit 31, the sensing chip 32, the plural light-emitting elements 33, a membrane switch circuit module 34, an illumination circuit board 35, a fixing sheet 36, a light guide plate 37, and a supporting plate 38.

The plural keys 30 are disposed over the fixing sheet 36. Each of the plural keys 30 comprises a keycap 301, an elastic element 302, and a connecting element 303. The keycap 301 has a light-outputting region (not shown) corresponding to a symbol region. The light-outputting region is made of a transparent material. Both of the elastic element 302 and the connecting element 303 are arranged between the keycap 301 and the fixing sheet 36. The elastic element 302 is fixed on the fixing sheet 36. In this embodiment, the connecting element 303 is a scissors-type connecting element, and the fixing sheet 36 is a polyethylene terephthalate (PET) film.

Then, the membrane switch circuit module 34 is disposed under the fixing sheet 36. In this embodiment, the membrane switch circuit module 34 comprises an upper wiring plate 341, an intermediate plate 342, and a lower wiring plate 343. A first circuit pattern 3411 is formed on a bottom surface of the upper wiring plate 341. The first circuit pattern 3411 comprises plural upper contacts 3411*a*. A second circuit pattern 3431 is formed on a top surface of the lower wiring plate 343. The second circuit pattern 3431 comprises plural lower contacts 3431*a* corresponding to the plural upper contacts 3411*a*. Each of the upper contacts 3411*a* and the corresponding lower contact 3431*a* are collaboratively defined as a membrane switch 344. In addition, each membrane switch 344 is aligned with a corresponding key 30.

The intermediate plate 342 is arranged between the upper wiring plate 341 and the lower wiring plate 343 for separating the upper wiring plate 341 and the lower wiring plate 343 from each other. Consequently, each of the upper contacts 3411*a* and the corresponding lower contact 3431*a* are separated from each other by a spacing distance. In addition, the intermediate plate 342 has plural perforations 3421 corresponding to the plural upper contacts 3411*a*.

When one of the keycaps 301 is depressed, the keycap 301 is assisted by the connecting element 303 to move downwardly. At the same time, the elastic element 302 is compressed by the keycap 301 and thus subject to deformation. Consequently, a protrusion part 3021 within the elastic element 302 is moved downwardly to push the membrane switch circuit module 34. Under this circumstance, the upper contact 3411*a* of the membrane switch 344 corresponding to the depressed keycap 301 is penetrated through the corresponding perforation 3421 and contacted with the corresponding lower contact 3431*a*. Consequently, the membrane switch circuit module 34 generates a corresponding key switch signal. According to the key switch signal, a corresponding function (e.g. a function of inputting a character, a symbol or a number into a computer system) is executed by the illuminated keyboard 3.

When the keycap 301 is no longer depressed, the elastic element 302 is restored to its original shape. Consequently, the keycap 301 is moved upwardly to the position where the keycap 301 is not depressed, and the connecting element 303 is also restored to its original state.

Then, the sensing circuit 31 is disposed on the membrane switch circuit module 34. In this embodiment, the sensing circuit 31 is a silver paste conductive line that is formed on the membrane switch circuit module 34 by a screen printing process. It is noted that the position of the sensing circuit 31 shown in the drawings is presented herein for purpose of illustration and description only. The sensing circuit 31 may be disposed on any appropriate surface of the upper wiring plate 341, the intermediate plate 342 or the lower wiring plate 343 of the membrane switch circuit module 34. However, the sensing circuit 31 is located near the wrist of the user while operating the illuminated keyboard 3. That is, the sensing circuit 31 is located near the space bar of the illuminated keyboard 3.

Moreover, the supporting plate 38 is disposed under the membrane switch circuit module 34 for enhancing the overall structural strength of the illuminated keyboard 3 and fixing the plural connecting element 303 of the plural keys 30. In this embodiment, the supporting plate 38 is an iron plate.

The connecting element 303 of each key 30 comprises a first frame 3031 and a second frame 3032. The first frame 3031 is pivotally coupled to the second frame 3032. In addition, the first frame 3031 and the second frame 3032 intersect each other. A first end 3031 a of the first frame 3031 and a first end 3032*a* of the second frame 3032 are connected to an inner surface of the keycap 301. A second end 3031*b* of the first frame 3031 and a second end 3032*b* of the second frame 3032 are connected to a first fixing structure 381 and a second fixing structure 382 of the supporting plate 38, respectively. Moreover, the first fixing structure 381 and the second fixing structure 382 of the supporting plate 38 are penetrated through the membrane switch circuit module 34 and the fixing sheet 36, and exposed over the fixing sheet 36.

Then, the light guide plate 37 is disposed under the membrane switch circuit module 34. The light guide plate 37 is used for transferring the light beams that is emitted by the plural light-emitting elements 33. Consequently, the light beams can be uniformly diffused to the regions under all of the keys 30. Moreover, it is preferred that the light guide plate 37 is made of a transparent light-guiding material with low absorptivity and high refractivity to the light beam. An example of the transparent light-guiding material includes but is not limited to polycarbonate (PC), polymethylmethacrylate (PMMA), polyethylene terephthalate (PET) or silicone.

Afterwards, the illumination circuit board 35 is disposed under the light guide plate 37. In addition, the plural light-emitting elements 33 and the sensing chip 32 are both disposed on the illumination circuit board 35. It is noted that the shape of the illumination circuit board 35, the number and the positions of the plural light-emitting elements 33 and the position of the sensing chip 32 shown in the drawings are presented herein for purpose of illustration and description only. Moreover, in this embodiment, the illumination circuit board 35 is a printed circuit board (PCB) or a flexible printed circuit (FPC).

More especially, in this embodiment, the height of the sensing chip 32 is substantially equal to the overall height of the fixing sheet 36, the membrane switch circuit module 34, the supporting plate 38 and the light guide plate 37. For providing an accommodation space to accommodate the sensing chip 32, the fixing sheet 36 has a second opening 361, the membrane switch circuit module 34 has a first opening 345, the supporting plate 38 has a third opening 383, and the light guide plate 37 has a fourth opening 371. The sensing chip 32 is sequentially penetrated through the fourth opening 371, the third opening 383, the first opening 345 and the second opening 361, and received within the region under the keycap 301 of a specified key with a larger width (e.g. the keycap 301 of the space bar).

Moreover, the light guide plate 37 further comprises plural receiving parts 372 for accommodating the plural light-emitting elements 33. Consequently, the light beams from the plural light-emitting elements 33 are laterally introduced into the light guide plate 37.

Moreover, in this embodiment, the sensing chip 32 is electrically connected with the sensing circuit 31 by a thermal bonding process. The thermal bonding process uses soldering paste to bond the sensing circuit 31 and the sensing chip 32 together. Alternatively, in some other embodiment, the sensing circuit 31 and the sensing chip 32 are bonded together by using an anisotropic conductive film (ACF). It is noted that the way of bonding the sensing circuit 31 and the sensing chip 32 together is not restricted.

Hereinafter, the operating principles of the illuminated keyboard 3 of this embodiment will be illustrated in more details. In this embodiment, the sensing circuit 31 is a non-contact sensing device. When the illumination circuit board 35 is electrically conducted, a sensing electric field is generated by the sensing circuit 31. Moreover, when a conducting object (e.g. a human body) is located near the sensing electric field, the sensing electric field is subject to a change. According to the change of the sensing electric field, the sensing chip 32 electrically connected with the sensing circuit 31 can judge that the conducting object (e.g. the human body) is located near the illuminated keyboard 3. Consequently, the sensing chip 32 will notify a controlling unit (not shown) of the illuminated keyboard 3 to drive illumination of the plural light-emitting elements 33. Under this circumstance, a backlight function is enabled.

When the conducting object (e.g. the human body) is far away from the sensing circuit 31, the sensing electric field is also subject to a change. According to the change of the sensing electric field, the sensing chip 32 will notify the controlling unit of the illuminated keyboard 3 to stop driving illumination of the plural light-emitting elements 33. Under this circumstance, the backlight function is disabled. In other words, by judging whether the user is located near the illuminated keyboard 3 or not, the backlight function of the illuminated keyboard 3 can be automatically enabled or disabled.

From the above discussions, the illuminated keyboard 3 of this embodiment uses the sensing circuit 31 and the sensing chip 32 to sense the presence of an object in order to automatically control the illumination of the plural light-emitting elements 33. Moreover, by disposing the sensing circuit 31 on the membrane switch circuit module 34 and disposing the sensing chip 32 on the illumination circuit board 35, the sensing chip 32 is accommodated within the corresponding openings of the fixing sheet 36, the membrane switch circuit module 34, the supporting plate 38 and the light guide plate 37. Since the illuminated keyboard 3 does not need an additional space to accommodate the sensing chip 32, the illuminated keyboard 3 can meet the requirement of slimness.

Figure 7:
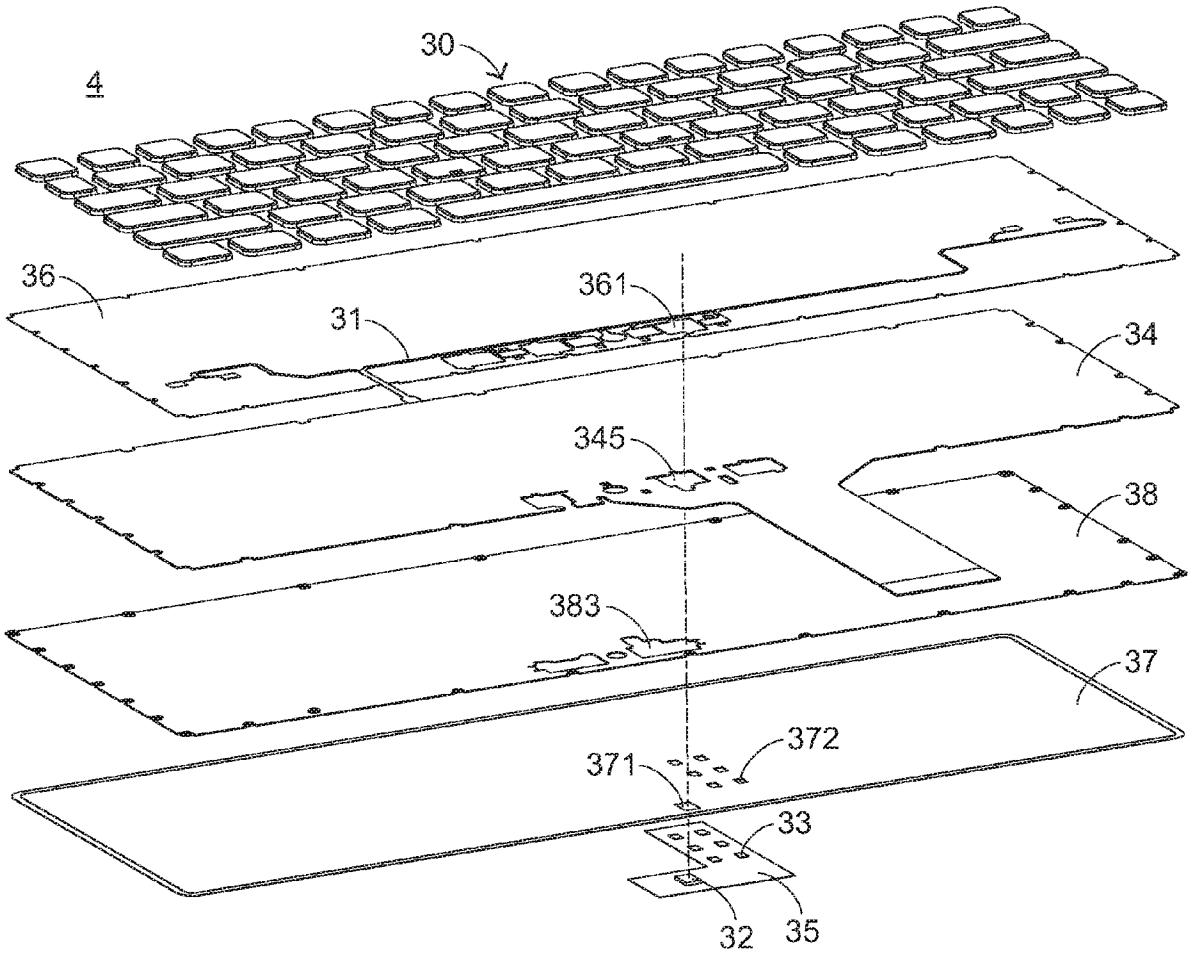
FIG. 7 is a schematic exploded view illustrating an illuminated keyboard according to a second embodiment of the present invention.
Figure 8:
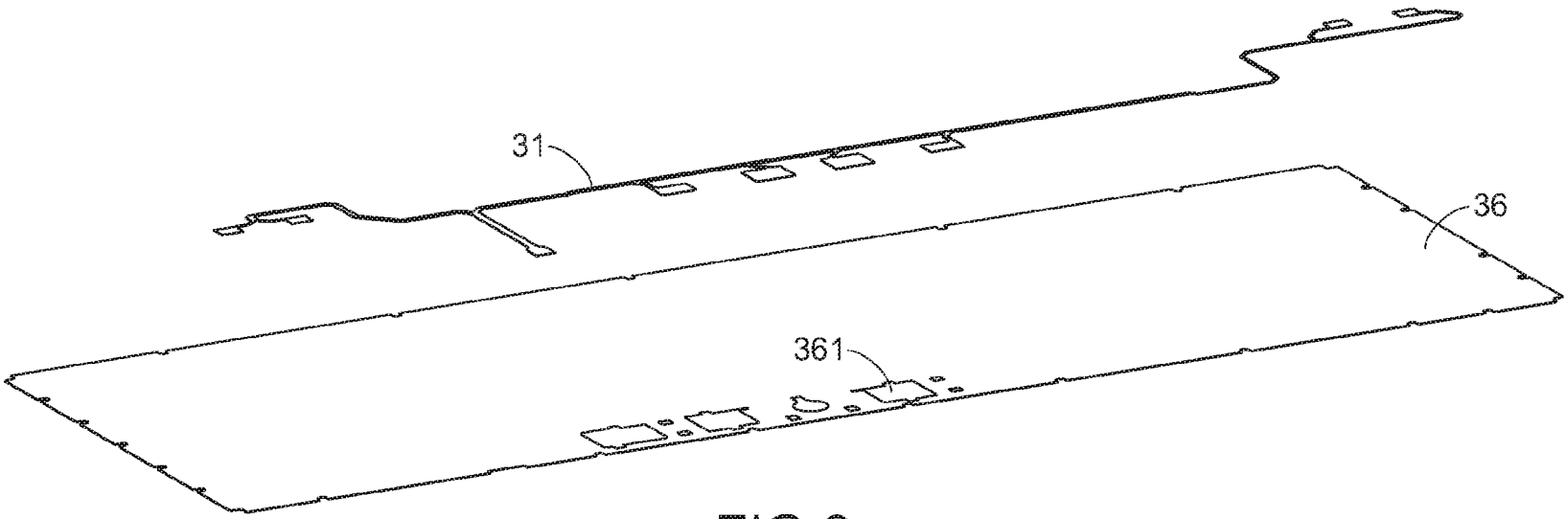
FIG. 8 is a schematic exploded view illustrating a fixing sheet and a sensing circuit of the illuminated keyboard according to the second embodiment of the present invention.

Hereinafter, the structures of an illuminated keyboard with an object sensing function according to a second embodiment of the present invention will be illustrated with reference to FIGS. 7 and 8. FIG. 7 is a schematic exploded view illustrating an illuminated keyboard according to a second embodiment of the present invention. FIG. 8 is a schematic exploded view illustrating a fixing sheet and a sensing circuit of the illuminated keyboard according to the second embodiment of the present invention.

Except that the sensing circuit 31 is formed on the fixing sheet 36 rather than the membrane switch circuit module 34, the illuminated keyboard 4 of this embodiment is substantially identical to the illuminated keyboard 3 of the first embodiment. The structures, the assembling sequence and the operating principles of the other components of the illuminated keyboard 4 are substantially identical to those of the illuminated keyboard 3 of the first embodiment, and are not redundantly described herein.

Figure 9:
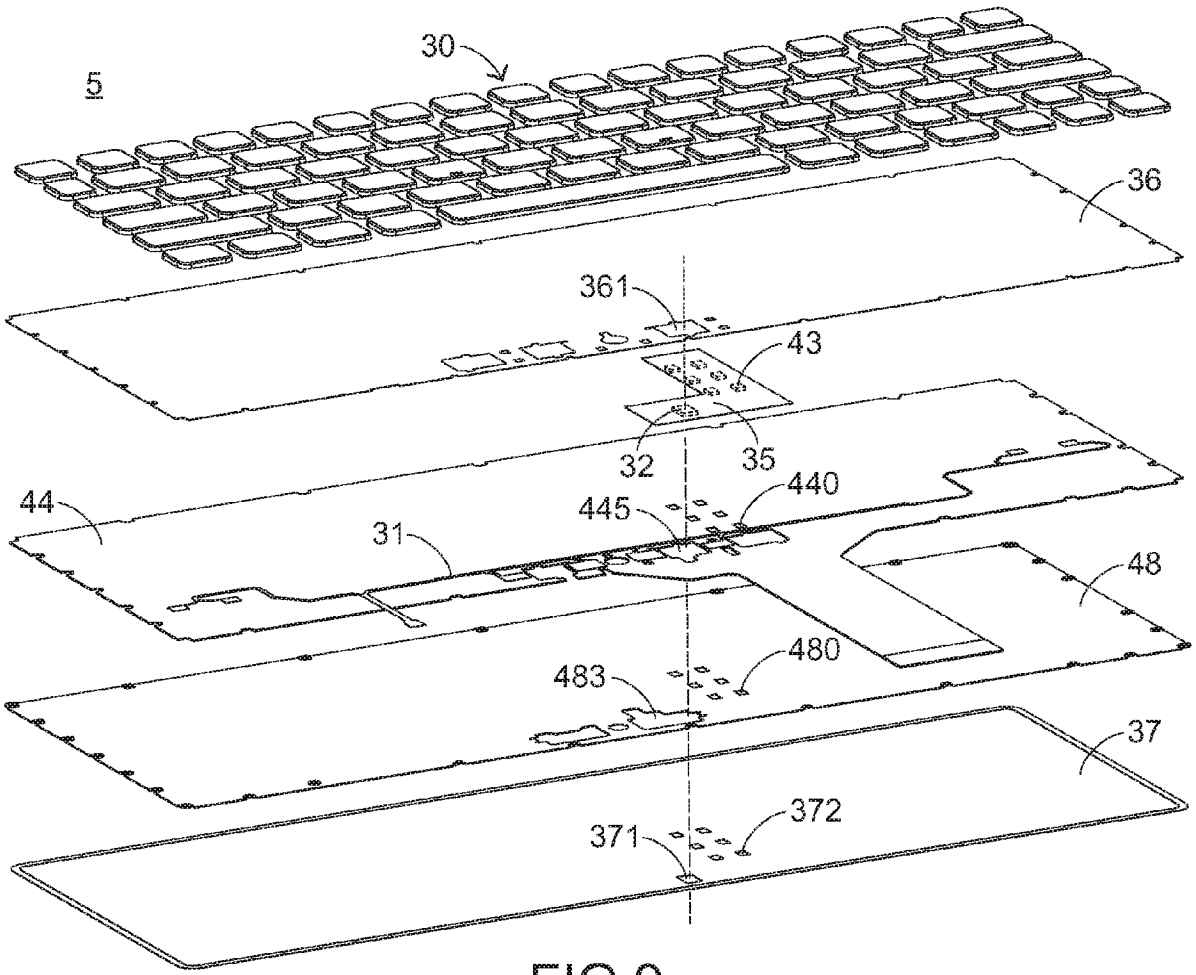
FIG. 9 is a schematic exploded view illustrating an illuminated keyboard according to a third embodiment of the present invention.
Figure 10:
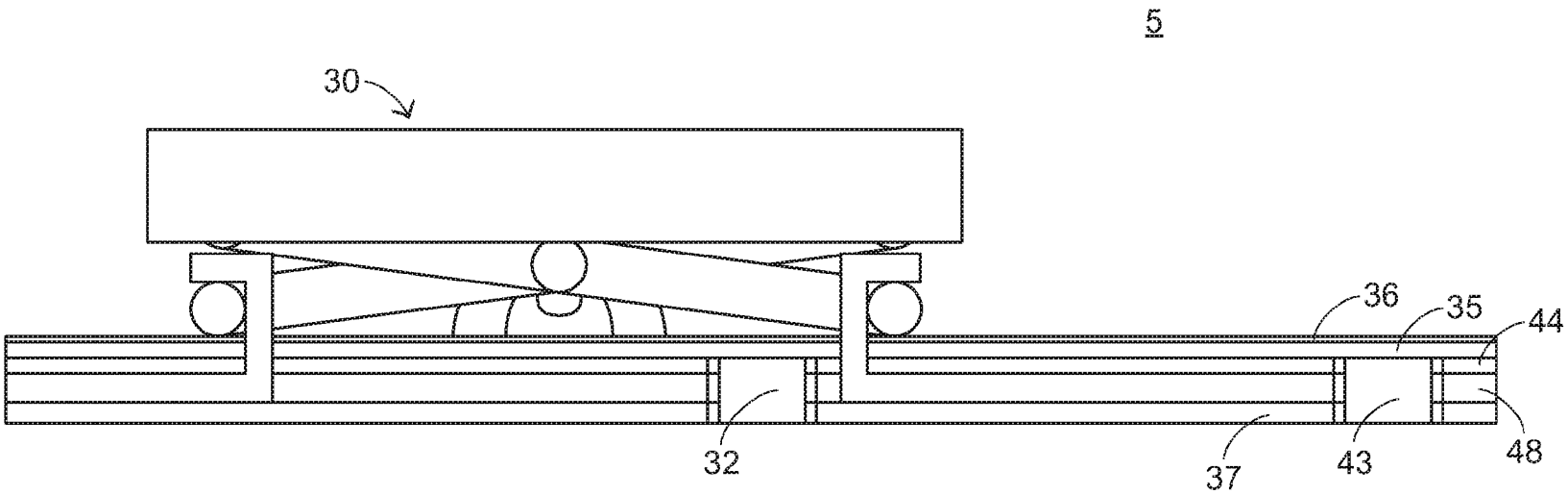
FIG. 10 is a schematic cross-sectional view illustrating the illuminated keyboard according to the third embodiment of the present invention.

Hereinafter, the structures of an illuminated keyboard with an object sensing function according to a third embodiment of the present invention will be illustrated with reference to FIGS. 9 and 10. FIG. 9 is a schematic exploded view illustrating an illuminated keyboard according to a third embodiment of the present invention. FIG. 10 is a schematic cross-sectional view illustrating the illuminated keyboard according to the third embodiment of the present invention.

As shown in FIGS. 9 and 10, the illuminated keyboard 5 comprises plural keys 30, a sensing circuit 31, a sensing chip 32, plural light-emitting elements 43, a membrane switch circuit module 44, an illumination circuit board 35, a fixing sheet 36, a light guide plate 37, and a supporting plate 48.

In comparison with the illuminated keyboard of the first embodiment, the illumination circuit board 35 is arranged between the fixing sheet 36 and the membrane switch circuit module 44. Consequently, it is not necessary to penetrate the sensing chip 32 through the fixing sheet 36. That is, the sensing chip 32 is sequentially penetrated through the first opening 445 of the membrane switch circuit module 44, the third opening 483 of the supporting plate 48 and the fourth opening 371 of the light guide plate 37, and received within the region under the keycap 301 of a specified key 30. Moreover, the size of the light-emitting element 43 of this embodiment is larger than the size of the light-emitting element 33 of the first embodiment. The plural light-emitting elements 43 are penetrated through the plural receiving parts 440 of the membrane switch circuit module 44, the plural receiving parts 480 of the supporting plate 48 and the plural receiving parts 372 of the light guide plate 37. Consequently, the light beams from the plural light-emitting elements 43 are laterally introduced into the light guide plate 37.

Moreover, in this embodiment, the sensing circuit 31 is disposed on the membrane switch circuit module 44, but is not limited thereto. The sensing circuit 31 is also disposed on any appropriate surface of the fixing sheet 36.

The structures, the assembling sequence and the operating principles of other components of the illuminated keyboard 5 are substantially identical to those of the illuminated keyboard 3 of the first embodiment, and are not redundantly described herein.

From the above descriptions, the illuminated keyboard uses the sensing circuit and the sensing chip to sense the presence or the absence of an object in order to automatically enable or disable the backlight function.

Moreover, in the illuminated keyboard of the present invention, the sensing chip is disposed on the illumination circuit board, and the sensing chip is accommodated within the corresponding openings of the fixing sheet, the membrane switch circuit module, the supporting plate and the light guide plate. Moreover, the sensing circuit is formed on the fixing sheet or the membrane switch circuit module. Since the illuminated keyboard of the present invention does not need an additional space to accommodate the sensing chip, the illuminated keyboard can meet the requirement of slimness.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An illuminated keyboard, comprising:

a membrane switch circuit module for generating plural key switch signals, wherein the membrane switch circuit module comprises a first opening;

plural keys disposed over the membrane switch circuit module, wherein when one of the plural keys is depressed, the membrane switch circuit module generates a corresponding key switch signal, wherein the plural keys comprise plural keycaps, respectively;

a sensing circuit disposed on the membrane switch circuit module;

an illumination circuit board;

at least one light-emitting element disposed on the illumination circuit board; and a sensing chip disposed on the illumination circuit board, wherein the sensing chip is penetrated through the first opening and electrically connected with the sensing circuit, wherein the sensing chip is disposed under one of the plural keycaps for sensing a presence of an object.

2. The illuminated keyboard according to claim 1, wherein the sensing circuit is a non-contact sensing device for generating a sensing electric field, wherein when the object is located near the sensing electric field, the sensing electric field is subject to a change, so that the presence of the object is sensed by the sensing chip.

3. The illuminated keyboard according to claim 2, wherein when the presence of the object is sensed by the sensing chip, the at least one light-emitting element is driven to emit a light beam.

4. The illuminated keyboard according to claim 1, wherein the illuminated keyboard further comprises a fixing sheet, and the fixing sheet is disposed over the membrane switch circuit module, wherein the plural keys further comprise respective elastic elements, wherein the plural elastic elements are disposed under the respective keycaps, and the plural elastic elements are fixed on the fixing sheet.

5. The illuminated keyboard according to claim 4, wherein the illuminated keyboard further comprises a light guide plate, wherein the light guide plate is disposed under the membrane switch circuit module for transferring a light beam, which is emitted by the at least one light-emitting element.

6. The illuminated keyboard according to claim 5, wherein the illuminated keyboard further comprises a supporting plate, which is arranged between the membrane switch circuit module and the light guide plate, wherein the plural keys comprises respective connecting elements for connecting the respective keycaps and the supporting plate.

7. The illuminated keyboard according to claim 6, wherein the fixing sheet comprises a second opening, the supporting plate comprises a third opening, and the light guide plate comprises a fourth opening, wherein the sensing chip is further penetrated through the second opening, the third opening and the fourth opening.

8. The illuminated keyboard according to claim 6, wherein the illumination circuit board is disposed over the membrane switch circuit module or under the light guide plate.

9. The illuminated keyboard according to claim 1, wherein the membrane switch circuit module comprises:

an upper wiring plate having a first circuit pattern, wherein the first circuit pattern comprises plural upper contacts;

a lower wiring plate having a second circuit pattern, wherein the second circuit pattern comprises plural lower contacts corresponding to the plural upper contacts, wherein each of the upper contacts and the corresponding lower contact are collaboratively defined as a membrane switch; and an intermediate plate arranged between the upper wiring plate and the lower wiring plate, so that each of the upper contacts and the corresponding lower contact are separated from each other by a spacing distance, wherein the intermediate plate comprises plural perforations corresponding to the plural upper contacts.

10. An illuminated keyboard, comprising:

a membrane switch circuit module for generating plural key switch signals, wherein the membrane switch circuit module comprises a first opening;

plural keys disposed over the membrane switch circuit module, wherein when one of the plural keys is depressed, the membrane switch circuit module generates a corresponding key switch signal, wherein the plural keys comprise plural keycaps and plural elastic elements, respectively, wherein the plural elastic elements are disposed under the corresponding keycaps;

a fixing sheet arranged between the plural keys and the membrane switch circuit module for fixing the plural elastic elements, wherein the fixing sheet comprises a second opening;

a sensing circuit disposed on the fixing sheet;

an illumination circuit board;

at least one light-emitting element disposed on the illumination circuit board; and a sensing chip disposed on the illumination circuit board, wherein the sensing chip is penetrated through the first opening and the second opening and electrically connected with the sensing circuit, wherein the sensing chip is disposed under one of the plural keycaps for sensing a presence of an object.

11. The illuminated keyboard according to claim 10, wherein the sensing circuit is a non-contact sensing device for generating a sensing electric field, wherein when the object is located near the sensing electric field, the sensing electric field is subject to a change, so that the presence of the object is sensed by the sensing chip.

12. The illuminated keyboard according to claim 11, wherein when the presence of the object is sensed by the sensing chip, the at least one light-emitting element is driven to emit a light beam.

13. The illuminated keyboard according to claim 10, wherein the illuminated keyboard further comprises a light guide plate and a supporting plate, wherein the supporting plate is disposed under the membrane switch circuit module, and the light guide plate is disposed under the supporting plate, wherein the plural keys further comprise plural connecting elements for connecting respective keycaps and the supporting plate.

14. The illuminated keyboard according to claim 13, wherein the supporting plate comprises a third opening, and the light guide plate comprises a fourth opening, wherein the sensing chip is further penetrated through the third opening and the fourth opening.

15. The illuminated keyboard according to claim 13, wherein the illumination circuit board is disposed over the membrane switch circuit module or under the light guide plate.

16. The illuminated keyboard according to claim 10, wherein the membrane switch circuit module comprises:

an upper wiring plate having a first circuit pattern, wherein the first circuit pattern comprises plural upper contacts;

a lower wiring plate having a second circuit pattern, wherein the second circuit pattern comprises plural lower contacts corresponding to the plural upper contacts, wherein each of the upper contacts and the corresponding lower contact are collaboratively defined as a membrane switch; and an intermediate plate arranged between the upper wiring plate and the lower wiring plate, so that each of the upper contacts and the corresponding lower contact are separated from each other by a spacing distance, wherein the intermediate plate comprises plural perforations corresponding to the plural upper contacts.

* * * * *